US011728602B2

(12) United States Patent
Deng et al.

(10) Patent No.: US 11,728,602 B2
(45) Date of Patent: Aug. 15, 2023

(54) CONNECTOR AND CABLE WITH CONNECTOR

(71) Applicant: Shenzhen Ke Xiu Technology Co., Ltd., Shenzhen (CN)

(72) Inventors: Shuyuan Deng, Shenzhen (CN); Huanhuan Zhu, Shenzhen (CN)

(73) Assignee: SHENZHEN KE XIU TECHNOLOGY CO., LTD., Shenzhen (CN)

( * ) Notice: Subject to any disclaimer, the term of this patent is extended or adjusted under 35 U.S.C. 154(b) by 51 days.

(21) Appl. No.: 17/412,252

(22) Filed: Aug. 25, 2021

(65) Prior Publication Data

US 2022/0069531 A1 Mar. 3, 2022

(30) Foreign Application Priority Data

Aug. 26, 2020 (CN) ..... 202021829235.9
Mar. 26, 2021 (CN) ..... 202120623891.1

(51) Int. Cl.
*H01R 31/06* (2006.01)
*H01R 13/506* (2006.01)
*H01R 13/62* (2006.01)

(52) U.S. Cl.
CPC ..... *H01R 31/065* (2013.01); *H01R 13/506* (2013.01); *H01R 13/6205* (2013.01)

(58) Field of Classification Search
CPC ..... H01R 13/02; H01R 13/46; H01R 13/62; H01R 13/6205; H01R 13/66;
(Continued)

(56) References Cited

U.S. PATENT DOCUMENTS 9,979,138 B1 * 5/2018 Chen ..... G01K 7/24
10,333,249 B1 * 6/2019 Wang ..... H01R 13/6205
2018/0331468 A1 * 11/2018 Little ..... H01R 12/724

FOREIGN PATENT DOCUMENTS

CN 105896168 B 11/2018

* cited by examiner

*Primary Examiner* — Oscar C Jimenez
(74) *Attorney, Agent, or Firm* — Andrew C. Cheng

(57) ABSTRACT

The present disclosure relates generally to the technical field of digital accessories, and more particularly to a connector and a cable with connector. The connector includes a first terminal head and a second terminal head. The first terminal head and the second terminal head are detachably connected. The first terminal head includes multiple first pins and a fixing member. The fixing member includes an upper fixing element and a lower fixing element. The multiple first pins are respectively fixed on the upper fixing element and the lower fixing element. A part of the multiple first pins passing through the upper fixing element, and the other part of the multiple first pins passing through the lower fixing element. When the first terminal head and the second terminal head are connected, one end of each first pin is electrically connected to the second terminal head, and the other end thereof is electrically connected to an external device. The cable with connector includes the connector mentioned above, a cable and an interface. One end of the cable is electrically connected to the second terminal head, and the other end thereof is connected to the interface. The connector provided in the present disclosure can fix the first pins in the first terminal head, without soldering, PCB boards, metal boards, etc., which reduces the manufacturing cost and avoids the soldering difficulty.

19 Claims, 10 Drawing Sheets

(58) Field of Classification Search
CPC ..... H01R 13/665; H01R 27/00; H01R 24/00;
H01R 31/06; H01R 31/065
See application file for complete search history.

CONNECTOR AND CABLE WITH CONNECTOR

TECHNICAL HELD

The present disclosure relates generally to the technical field of digital accessories, and more particularly to a connector and a cable with connector.

BACKGROUND

With the popularization of electronic products, they have become an indispensable part of people's lives. Data cables for charging and data transmission of electronic products is also necessary.

In the existing data cables, their plugs are usually provided with metalwork and PCB boards which are vertically connected. Pins are disposed on the metalwork and electrically connected to the PCB boards. This structure is complicated to assemble, and it is difficult to set the pins.

Further, in the existing data cables, the pins on terminal heads need to be soldered on the circuit board. Due to small volumes of the terminal heads, it is difficult to solder the pins. The soldering method limits the number of pins set on the circuit board.

SUMMARY

To overcome the defect of the existing data cables, the present disclosure provides a connector and a cable with connector.

To solve the technical problem, an embodiment of the present disclosure provides a connector. The connector includes a first terminal head and a second terminal head. The first terminal head and the second terminal head are detachably connected. The first terminal head includes multiple first pins and a fixing member. The fixing member includes an upper fixing element and a lower fixing element. The multiple first pins are respectively fixed on the upper fixing element and the lower fixing element. A part of the multiple first pins passing through the upper fixing element, and the other part of the multiple first pins passing through the lower fixing element. When the first terminal head and the second terminal head are connected, one end of each first pin is electrically connected to the second terminal head, and the other end thereof is electrically connected to an external device.

Preferably, the first pins passing through the upper fixing element correspond to the first pins passing through the lower fixing element one by one.

Preferably, the first terminal head further includes a supporting clamp. The supporting clamp is partially accommodated in a through slot. The through slot is defined by the upper fixing element and the lower fixing element.

Preferably, one of the supporting clamp and the fixing member includes a positioning column, the other one thereof includes a positioning hole. The supporting clamp and the fixing member are matched by the positioning column and the positioning hole.

Preferably, the first terminal head further includes a protective shell. The multiple first pins, the fixing member and the supporting clamp are disposed in the protective shell. The protective shell defines a dodging slot for dodging the supporting clamp.

Preferably, one of the protective shell and the fixing member includes an engagement block, the other one thereof defines an engagement hole. The protective shell and the fixing member cooperate through the engagement block and the engagement hole.

Preferably, the first terminal head includes an integration part which is connected to an end of the protective shell, closing to the fixing member. The integration part defines multiple seating grooves corresponding to the multiple first pins. The multiple first pins are disposed in the multiple seating groove.

Preferably, the integration part includes a port disposed at an end thereof away from the fixing member. The second terminal head includes a plugboard provided with a plurality of second pins. When the first terminal head and the second terminal head are connected, the plugboard inserts into the port, and the first pins passing through the upper fixing element and the corresponding first pins passing through the lower fixing element elastically electrically connect to the plurality of second pins.

Preferably, the first terminal head includes a first magnetic member sleeved on the end of the protective shell, closing to the integration part. The second terminal head includes a second magnetic member sleeved on the plugboard. The first magnetic member and the second magnetic member are magnetically connected.

Preferably, the fixing member defines multiple fitting grooves at one end thereof, and multiple connecting slots at the other end. One end of each first pin fits the multiple fitting grooves and is exposed from the fixing member, the other end thereof passes through the connecting slot.

Preferably, the second terminal head includes the multiple second pins. The number of the multiple first pins disposed in the first terminal head is 16, and the number of the multiple second pins disposed in the second terminal head is 24. When the first terminal head and the second terminal head are connected, one of the multiple first pins is correspondingly contacted with one of the multiple second pins.

Preferably, each of the upper fixing member and the lower fixing member are correspondingly provided with the multiple fitting grooves and the multiple connecting slots. One end of each first pin fits one fitting groove of the upper fixing member or the lower fixing member, the other end thereof passes through one connecting slot of the upper fixing member or the lower fixing member. The upper fixing member defines an upper notch between the fitting groove and the connecting slot. The lower fixing member defines a lower notch between the fitting groove and the connecting slot. The upper notch and the lower notch cooperate to define an accommodating room.

Preferably, the first terminal head further includes a casing. The casing includes an outer housing and a connecting element. The connecting element is accommodated in the accommodating room, and two ends of the connecting element extend out the accommodating room to connect to two opposite inner walls of the outer housing.

Preferably, the upper notch includes an upper ground hole, and the lower notch includes a lower ground hole. One of the multiple first pins corresponds to the upper ground hole, being exposed by the upper ground hole of the upper notch from the upper fixing element and contacted with the connecting element. One of the multiple first pins passes through the lower ground hole, being exposed by the lower ground hole of the lower notch from the lower fixing element and contacted with the connecting element.

Preferably, the first terminal head includes an injection mold. The fixing member is disposed in the injection mold. A part of the multiple first pins, which fits the fitting groove and is exposed from the fixing member, is also exposed from the injection mold. The injection mold is disposed in the casing, and an outer wall of the injection mold matches to an inner wall of the casing.

Preferably, the first terminal head includes a collection part which matches an end of the casing, closing to the connecting slot, the other ends of the plurality of first pins passing through the connecting slot are fixed in the collection part.

Preferably, the first terminal head includes the first magnetic member and an adapting member. The first terminal head is sleeved on the fixing member, and the adapting member is sleeved on the first magnetic member.

Preferably, the second terminal head includes a second fixing member, a PCB board, the multiple second pins and the plugboard. The second fixing member is disposed in the plugboard. A part of the multiple second pins, which fits the fitting groove and is exposed from the second fixing member, is also exposed from the plugboard. An end of the multiple second pins close to the connecting slot is connected to the PCB board.

Preferably, the second terminal head further includes the second magnetic member and a second protective shell. The second magnetic member is sleeved on the plugboard, and the second protective shell is sleeved on the second magnetic member.

To solve the above-mentioned technical problem, another embodiment of the present disclosure further provides a cable with connector. The cable with connector includes the connector mentioned above, a cable and an interface. One end of the cable is electrically connected to the second terminal head, and the other end thereof is connected to the interface. The first terminal head and the second terminal head being magnetically attracted and plug-fitted to form an electrical connection, thereby realizing the electrical connection between the first terminal head, the second terminal head and the interface.

Compared with the prior arts, the connector and the cable with connector provided in the present disclosure have the following beneficial effects.

The connector provided in the present disclosure includes a first terminal head and a second terminal head. The first terminal head includes multiple first pins and a fixing member. The multiple first pins are fixed to the fixing member, which can fix the first pins in the first terminal head, without soldering, PCB boards, metal boards, etc., further reduce the manufacturing cost and avoid the soldering difficulty. At the same time, due to the limited volume of the first terminal head, more first pins can be fixed in the first terminal head without soldering, which is simple, easy to assemble, disassemble and maintain.

The connector provided in the first embodiment of the present disclosure includes an adapting member. The adapting member includes a mating part and a limiting part. The limiting part makes the first terminal head easier detached from the second terminal head.

The first terminal head provided in the first embodiment of the present disclosure includes 24 first pins, which has faster speed of charging and data transmission when in use.

The first terminal head includes a supporting clamp which can provide support for the housing, so that the housing is more stably fixed on the first terminal head.

One of the protective shell and the fixing member includes an engagement block, the other one thereof defines an engagement hole. The protective shell and the fixing member cooperate through the engagement block and the engagement hole, which can fix the fixing member in the protective shell more stably and avoid shaking of the fixing member.

In the connector provided in the second embodiment of the present disclosure, the upper notch defines an upper positioning column and an upper positioning hole, the lower notch defines a lower positioning column and a lower positioning hole. The upper positioning column matched the lower positioning hole, the lower positioning column matches the upper positioning hole, so that the upper fixing element and the lower fixing element can be positioned and assembled quickly, thereby optimizing the assembling process.

The upper notch and the lower notch cooperate to define an accommodating room. The connecting element of the casing is accommodated in the accommodating room. The casing and the fixing member match, so that the casing and the fixing member are not easy to move relative to each other, and the fixing member is more stably fixed in the casing.

The upper ground hole and the lower ground hole are provided, which enables the first pins to be grounded. While ensuring the normal operation of the first terminal head, the first pins do not need to be soldered with the casing, which reduces the manufacturing cost and avoids the soldering difficulty.

The fixing member is disposed in the injection mold. The injection mold protects the fixing member and the first pins, which can avoid damage to the fixing member and the first pins, and improve the service life of the product.

The cable with connector provided in the third embodiment of the present disclosure includes the connector provided in the first embodiment, and/or the connector provided in the second embodiment. The fixing member of the first terminal head fix the first pins in the first terminal head, without soldering, PCB boards, metal boards, etc., which reduces the manufacturing cost and avoids the soldering difficulty. The second terminal head can match the first terminal head of different specifications, which improves the applicability.

NUMERICAL REFERENCE IDENTIFICATION

100. Connector; 1. First terminal head; 11. Fixing member; 12. First pin; 110. Hole; 111. Upper fixing element; 112. Lower fixing element; 113. Engagement block; 13. Supporting clamp; 131. Supporting leg; 132. Main body; 1111. Through slot; 1112. Positioning column; 1321. Positioning hole; 14. Protective shell; 141. Dodging slot; 144. Engagement hole; 15. Housing; 16. Integration part; 17. Adapting member; 171. Mating part; 172. Limiting part; 18. First magnetic member; 161. Seating groove; 162. Lug; 142. Receiving space; 143. Limiting groove; 2. Second terminal head; 19. Port; 21. Chamber; 22. Plugboard; 23. Second pin; 24. Second magnetic member;

200. Connector; 1'. First terminal head; 11'. Fixing member; 110'. Accommodating room; 111'. Fitting groove; 112'. Connecting slot; 113'. Upper fixing element; 1131'. Upper notch; 1132'. Upper positioning column; 1133'. Upper positioning hole; 1134'. Upper ground hole; 114'. Lower fixing element; 1141'. Lower notch; 1142'. Lower positioning column; 1143'. Lower positioning hole; 1144'. Lower ground hole; 12'. First pin; 13'. Casing; 131'. Outer housing; 132'. Connecting element; 1321'. First open end; 1322'. Second open end; 133'. Recess; 14'. Injection mold; 15'. Collection part; 151'. Seating groove; 152'. Port; 16'. First magnetic member; 1'. Adapting member; 2'. Second terminal head; 21'. Plugboard; 211'. Second pin; 22'. Second magnetic member; 23'. Second fixing member; 24'. Second protective shell; 25'. PCB board;

300. Cable with connector; 31. Cable.

DETAILED DESCRIPTION

In order to make the objectives, technical solutions, and advantages of the present disclosure clearer, the present disclosure is further described in detail below with reference to the accompanying drawings and embodiments. It should be understood that the specific embodiments described herein are provided for illustration only, and not for the purpose of limiting the disclosure.

It should be noted that, when an element is considered to be "fixed" to another element, it can be directly fixed on another element or a centered element is arranged between the element and another element. When an element is considered to be "connected" to another element, it can be directly connected to another element or there can also have a centered element. It should be further noted that terms such as "vertical", "horizontal", "left", "right" or the like are just used to facilitate description of the present disclosure.

Figure 1:
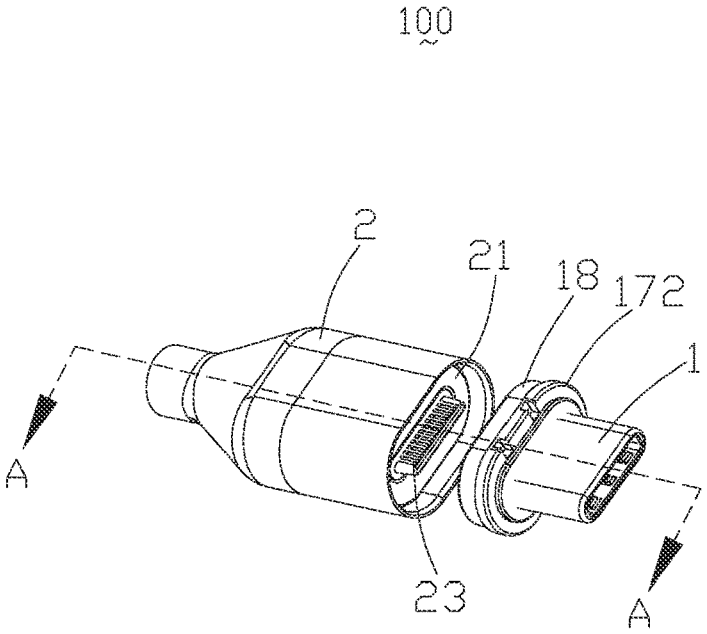
FIG. 1 is a schematic diagram of a first terminal head and a second terminal head of a connector according to a first embodiment of the present disclosure.
Figure 2:
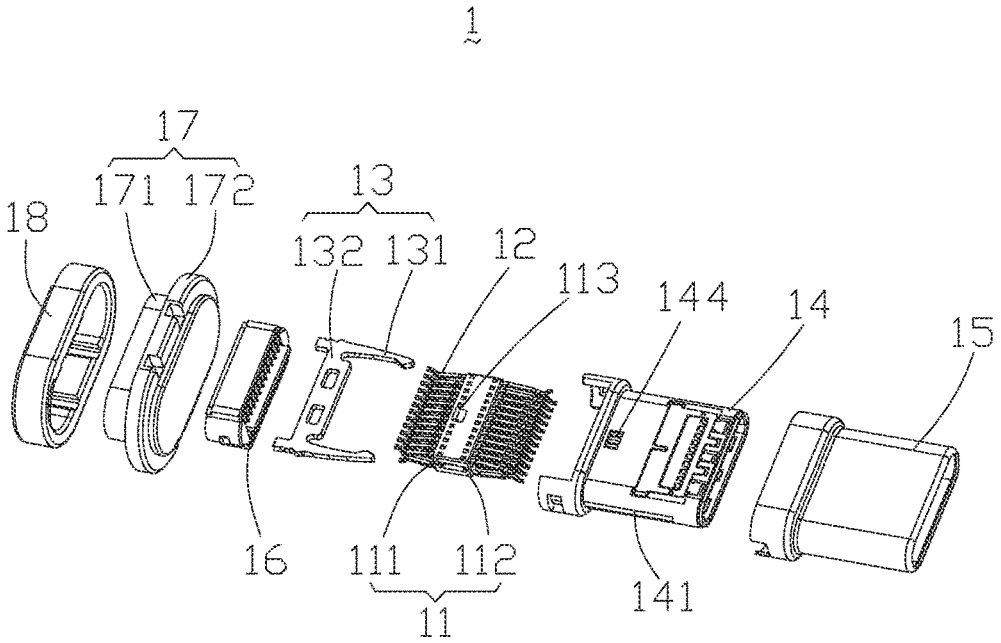
FIG. 2 is an exploded schematic diagram of the first terminal head according to the first embodiment of the present disclosure.

Referring to FIG. 1 and FIG. 2, a first embodiment of the present disclosure provides a connector 100. The connector 100 includes a first terminal head 1 and a second terminal head 2. The first terminal head 1 and the second terminal head 2 are detachably connected. In this embodiment, the first terminal head 1 takes a type-c plug as an example for detailed description. The first terminal head 1 includes a fixing member 11 and multiple first pins 12. The multiple first pins 12 are fixed to the fixing member 11, and an end of each first pin 12 is exposed from the fixing member 11. When the first terminal head 1 is connected to the second terminal head 2, the end of each first pin 12 exposed from the fixing member 11 is electrically connected to the second terminal head 2. Both ends of the multiple first pins 12 are elastic terminals.

Figure 3:
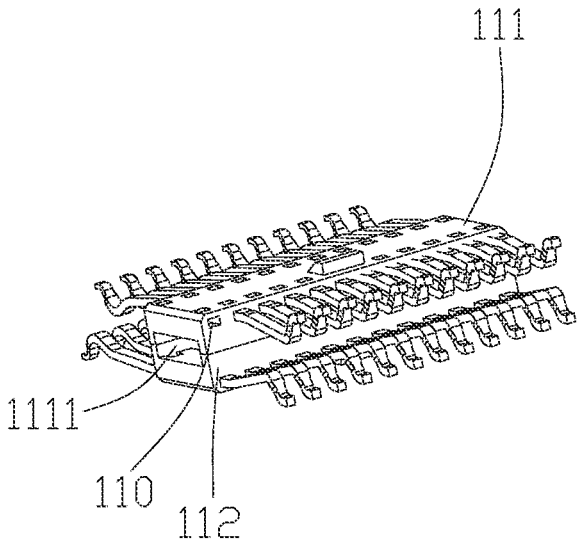
FIG. 3 is a perspective view of a fixing member of the first terminal head according to the first embodiment of the present disclosure.

Referring to FIG. 3, the fixing member 11 defines multiple holes 110. The diameter of each hole 110 is equivalent to the outer diameter of each first pins 12, so that the multiple first pins 12 pass through the holes 110 to be fixed to the fixing member 11. The multiple first pins 12 can be fixed in the first terminal head 1 by the fixing member 11. The fixing member 11 enables the multiple first pins 12 to be fixed in the first terminal head 1 without soldering, which reduces the manufacturing cost and avoids the difficulty of soldering. Meanwhile, due to the limited volume of the first terminal head 1, it is only necessary to design the arranging density of the holes 110 on the fixing member 11, so that more first pins 12 can be fixed in the first terminal head 1, without soldering.

In this embodiment, the fixing member 11 includes an upper fixing element 111 and a lower fixing element 112. The upper fixing element 111 and the lower fixing element 112 match each other. The number of the multiple first pins 12 is 24. The multiple first pins 12 are divided into two groups corresponding to each other, respectively passing through the upper fixing element 111 and the lower fixing element 112. Two ends of the multiple first pins 12 are respectively exposed from the fixing member 11. Specifically, 12 of the multiple first pins 12 pass through the upper fixing element 111, and another 12 of the multiple first pins 12 pass through the lower fixing element 112, so that the 24 first pins 12 are fixed to the fixing member 11.

In some other embodiments, the first pins 12 passing through the upper fixing element 111 and the first pins 12 passing through the lower fixing element 112 can be alternately arranged. The number of the multiple first pins 12 can be 10, 12, 36, etc.

Referring to FIG. 2 and FIG. 3, the first terminal head 1 further includes a supporting clamp 13. In the specific embodiment, the supporting clamp 13 includes a supporting leg 131 and a main body 132. The supporting leg 131 and the main body 132 are integrally formed. The supporting leg 131 is disposed on both sides of the main body 132, forming an U-shaped shape. The upper fixing element 111 and the lower fixing element 112 cooperate to define a through slot 1111. The main body 132 is disposed in the through slot 1111, and the supporting leg 131 is exposed from the fixing member 11.

Figure 4:
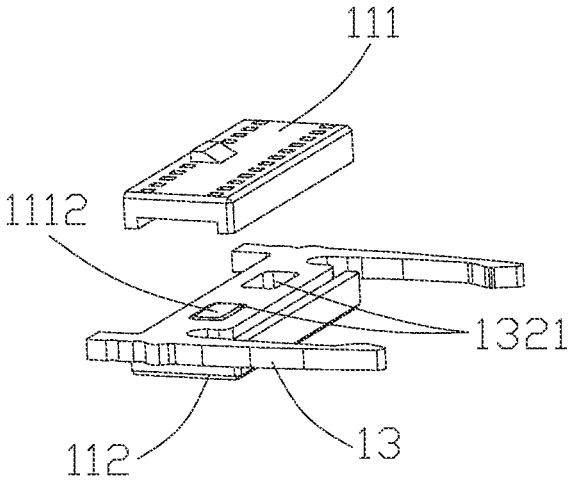
FIG. 4 is a perspective view of a supporting clamp and the fixing member of the first terminal head according to the first embodiment of the present disclosure.

Referring to FIG. 4, a positioning hole 1321 is defined on the main body 132, and a positioning column 1112 is correspondingly defined in the through slot 1111. The positioning hole 1321 matches the positioning column 1112 to fix the fixing member 11 to the supporting clamp 13.

In some other embodiments, the supporting leg 131 and the main body 132 are detachably connected. Specifically, the supporting leg 131 and the main body 132 are connected in a magnetic, clamping, thread manner or any combination of the above.

In an alternative embodiment, the positioning hole 1321 is defined in the through slot 1111, and the positioning column 1112 is correspondingly defined on the main body 132.

Referring to FIG. 2 again, the first terminal head 1 further includes a protective shell 14. The fixing member 11, the multiple first pins 12 and the supporting clamp 13 are disposed in the protective shell 14. A dodging slot 141 is defined on two sides of the protective shell 14, for dodging the supporting leg 131. That is, the supporting leg 131 is partially placed in the dodging slot 141, and partially exposed from the dodging slot 141.

It can be understood that, when the supporting leg 131 of the supporting clamp 13 matches the dodging slot 141 of the protective shell 14, the supporting clamp 13 is fixed in the protective shell 14, thereby fixing the fixing member 11 and the multiple first pins 12 which are fixed to the supporting clamp 13 in the protective shell 14.

The first terminal head 1 further includes a housing 15 which is sleeved on the protective shell 14. The part of the supporting leg 131 exposed from the protective shell 14 resists the housing 15, so as to fix the housing 15 to the protective shell 14.

It can be understood that, in the first embodiment of the present disclosure, the supporting leg 131 is disposed on the two sides of the main body 132, forming an U-shaped supporting clamp 13. When the housing 15 is sleeved on the protective shell 14, the inner wall of the housing 15 presses the part of the supporting leg 131 exposed from the protective shell 14, thereby deforming the supporting leg 131. That is, the housing 15 applies a force on the supporting leg 131, so that the supporting leg 131 generates a counterforce to the housing 15. The counterforce is a supporting force of the supporting clamp 13 to the housing 15, which can fix the housing 15 to the protective shell 14.

Referring to FIG. 2 again, an engagement hole 144 is defined on the protective shell 14, and an engagement block 113 is disposed on the outer surface of the fixing member 11. When the fixing member 11 is accommodated in the protective shell 14, the engagement hole 144 and the engagement block 113 are engaged, thereby limiting the movement of the fixing member 11 and fixing the fixing member 11 in the protective shell 14.

In some other embodiments, the engagement block 113 can be disposed on the protective shell 14, and the engagement hole 144 can be defined on the fixing member 11.

Figure 5:
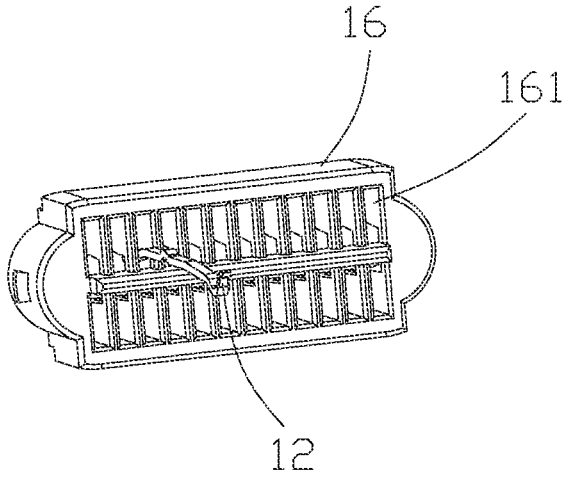
FIG. 5 is a perspective view of an integration part of the first terminal head according to the first embodiment of the present disclosure.
Figure 6:
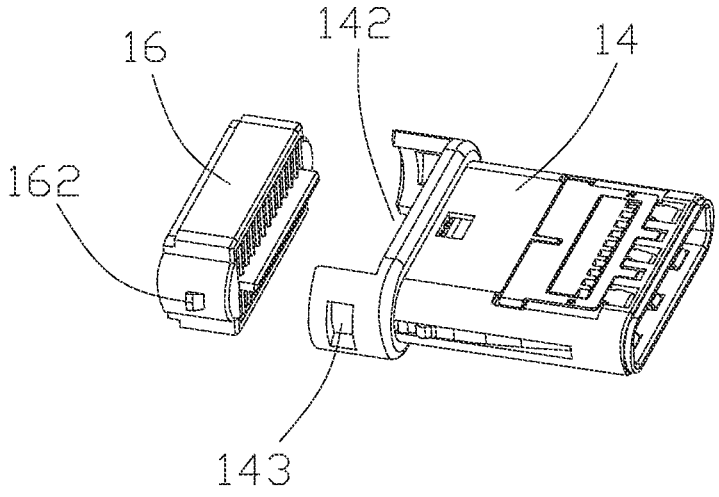
FIG. 6 is a perspective view of a protective shell an the integration part of the first terminal head according to the first embodiment of the present disclosure.

Referring to FIG. 5 and FIG. 6, the first terminal head 1 includes an integration part 16 for integrating the first pins 12. The integration part 16 is connected to an end of the protective shell 14, closing to the fixing member 11. The integration part 16 defines multiple seating grooves 161 corresponding to the first pins 12. The end of each first pin 12 exposed from the fixing member 11 is disposed in each seating groove 161. It can be understood that, in this embodiment, the multiple first pins 12 fixed in the fixing member 11 are arranged in two rows, upper and lower, and are respectively fixed to the upper fixing element 111 and the lower fixing element 112. Accordingly, the multiple seating grooves 161 are correspondingly arranged in two rows, so as to place the multiple first pins 12 exposed from the fixing member 11.

It can be understood that, in the first embodiment of the present disclosure, the protective shell 14 defines a receiving space 142 at an end thereof, closing to the integration part 16, for receiving the integration part 16. The multiple first pins 12 pass through the receiving space 142 and are accommodated in the multiple seating grooves 161. Further, the integration part 16 includes a lug 162 disposed on the outer surface thereof. The protective shell 14 defines a limiting groove 143 corresponding to the lug 162. The lug 162 and the limiting groove 143 match to fix the integration part 16 to the protective shell 14. Referring to FIG. 1 again, when the housing 15 is sleeved on the protective shell 14, the housing 15 covers and protects the integration part 16.

In some other embodiments, the lug 162 can be disposed on the protective shell 14, and the limiting groove 143 can be defined on the integration part 16.

Figure 7:
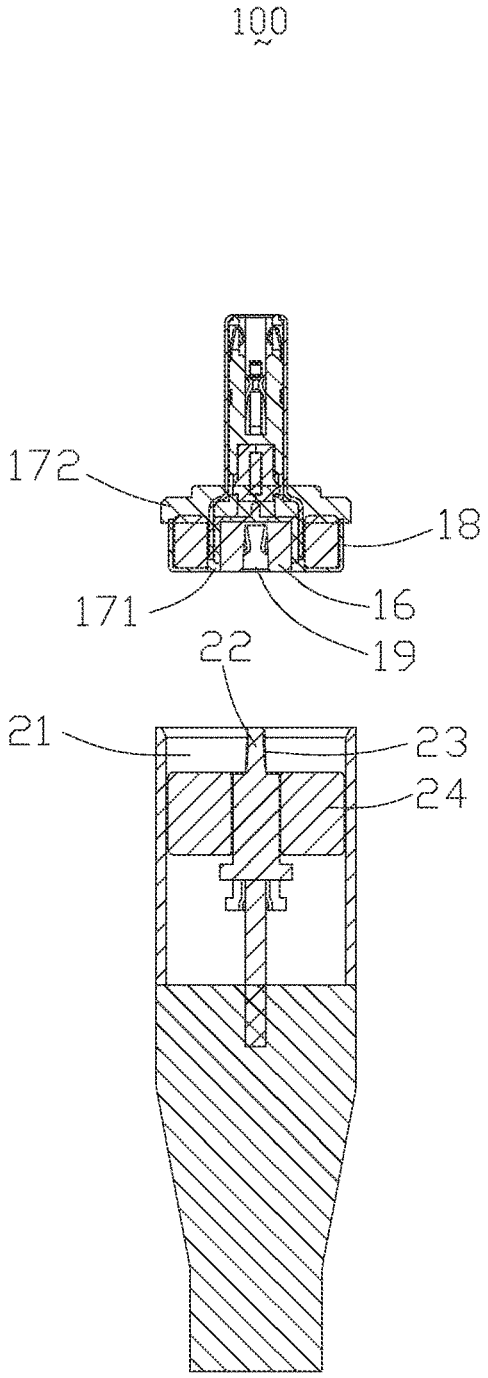
FIG. 7 is a cross-sectional schematic diagram of the connector in a direction A-A shown in FIG. 1.

Referring to FIG. 1, FIG. 2 and FIG. 7, the first terminal head 1 further includes an adapting member 17 and a first magnetic member 18. The adapting member 17 is sleeved on an end of the housing 15, closing to the integration part 16. The adapting member 17 includes a mating part 171 and a limiting part 172. The first magnetic member 18 is sleeved on the mating part 171.

Referring to FIG. 1 and FIG. 7 again, the second terminal head 2 defines a chamber 21 at an end thereof connecting to the first terminal head 1. It can be understood that, the mating part 171 is configured according to the shape of the second terminal head 2, so that the mating part 171 and the first magnetic member 18 of the first terminal head 1 are accommodated in the chamber 21. The limiting part 172 resists the edge of the chamber 21. The second terminal head 2 further includes a plugboard 22 and a second magnetic member 24. The plugboard 22 and the second magnetic member 24 are disposed in the chamber 21. The plugboard 22 includes multiple second pins 23 thereon. The integration part 16 includes a port 19 at an end away from the fixing member 11, corresponding to the plugboard 22. The first magnetic member 18 and the second magnetic member 24 are magnetically connected to achieve a magnetic connection between the first terminal head 1 and the second terminal head 2.

When the first terminal head 1 and the second terminal head 2 are connected, the plugboard 22 and the port 19 are connected, and the multiple first pins 12 in the integration part 16 are in contact with the multiple second pins 23 on the plugboard 22. Therefore, the plugboard 22 and the port 19 are electrically connected, thereby realizing an electrical connection between the first terminal head 1 and the second terminal head 2. Different first terminal heads 1 can be replaced to charge different electronic devices. Further, when the first terminal head 1 and the second terminal head 2 are connected, the first magnetic member 18 and the mating part 171 are accommodated in the chamber 21, and the limiting part 172 resists the edge of the chamber 21. When the first terminal head 1 is detached from the second terminal head 2, a force can be applied to the limiting part 172 to detach the first terminal head 1. The limiting part 172 allows the first terminal head 1 to be detached from the second terminal head 2 more easily.

Figure 8:
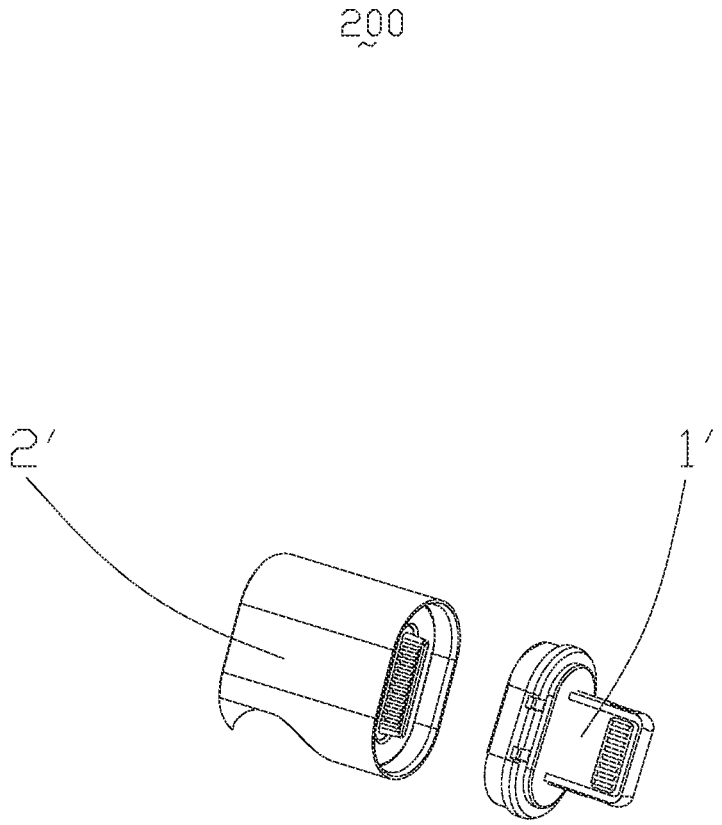
FIG. 8 is a schematic diagram of the first terminal head and the second terminal head of the connector according to a second embodiment of the present disclosure.
Figure 9:
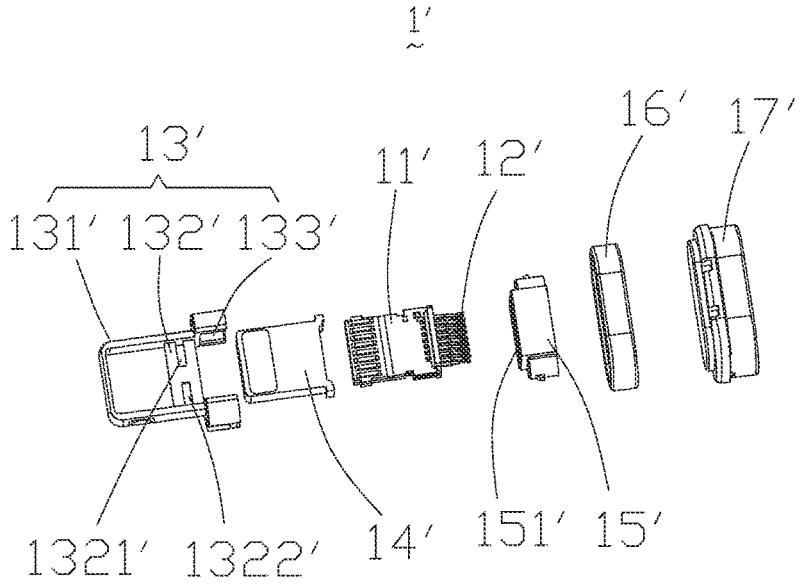
FIG. 9 is an exploded schematic diagram of the first terminal head according to the second embodiment of the present disclosure.
Figure 10:
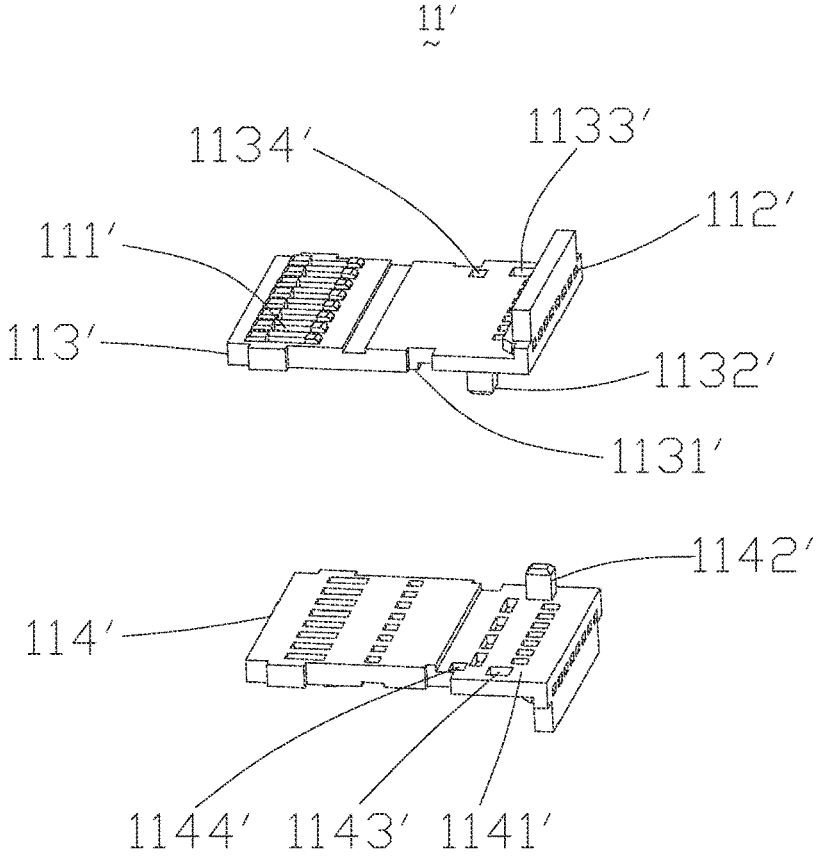
FIG. 10 is a schematic diagram of the fixing member according to the second embodiment of the present disclosure.

Referring to FIGS. 8-10, a second embodiment of the present disclosure provides a connector 200. The connector 200 includes a first terminal head and a second terminal head 2'. The first terminal head 1' and the second terminal head 2' are detachably connected. In this embodiment, the first terminal head 1' takes a lightning plug as an example for detailed description. The first terminal head 1' includes a fixing member 11' and multiple first pins 12'. The multiple first pins 12' pass through the fixing member 11' and are fixed to the fixing member 11'. Two ends of the multiple first pins 12' are respectively exposed from two ends of the fixing member 11' The multiple first pins 12' are arranged in two parallel rows. The fixing member 11' is formed by an injection molding according to the arrangement of the multiple first pins 12'. The fixing member 11' which is injection-molded defines multiple fitting grooves 111' at one end and multiple connecting slots 112' at the other end. One end of each first pin 12' fits one fitting groove 111' and is exposed from the fixing member 11', the other end thereof passes through one connecting slot 112' and is exposed from the fixing member 11'. The end of each first pin 12', which passes through one connecting slot 112' and is exposed from the fixing member 11', is electrically connected to the second terminal head 2'. The fixing member 11' can fix and accommodate the multiple first pins 12', so that the multiple first pins 12' are fixed in the fixing member 11' in a desired arrangement.

It can be understood that, the fixing member 11' and the multiple first pins 12' are applicable for the first terminal head 1' and the second terminal head 2'. In this embodiment, the fixing member 11' is disposed in the first terminal head 1'. One first pin 12' corresponds to one fitting groove 111' and one connecting slot 112'. That is, one end of each first pin 12' fits one fitting groove 111' and is exposed from the fixing member 11', the other end thereof passes through one connecting slot 112' and is exposed from the fixing member 11'. The number of the multiple first pins 12' is consistent with that of the multiple fitting grooves 111' and that of the multiple connecting slots 112'.

In some other embodiments, the number of the multiple fitting grooves 111' and that of the multiple connecting slots 112' can be one. The multiple first pins 12' are arranged in parallel. One end of each first pin 12' fits the one fitting groove 111' and is exposed from the fixing member 11', and the other end thereof passes through the one connecting slot 112' and is exposed from the fixing member 11'.

Referring to FIG. 10, the fixing member 11' includes an upper fixing element 113' and a lower fixing element 114. The upper fixing element 113' and the lower fixing element 114' match each other. The upper fixing element 113' defines the multiple fitting grooves 111' and the multiple connecting slots 112' at two ends. The lower fixing element 114' correspondingly defines the multiple fitting grooves 111' and the multiple connecting slots 112' at two ends. That is, the multiple connecting slots 112' of the upper fixing element 113' corresponds to the multiple connecting slots 112' of the lower fixing element 114'; the multiple fitting grooves 111' of the upper fixing element 113' corresponds to the multiple fitting grooves 111' of the lower fixing element 114'.

It can be understood that, in the second embodiment of the present disclosure, the first pins 12' fixed to the upper fixing element 113' correspond to the first pins 12' fixed to the lower fixing element 114'. In this embodiment, the number of the multiple first pins 12' is 16, of which 8 of the multiple first pins 12' are fixed on the upper fixing element 113', and another 8 of the multiple first pins 12' are fixed on the lower fixing element 114'. Therefore, the number of the multiple fitting grooves 111' and that of the multiple connecting slots 112' defined on the upper fixing element 113' are respectively 8, the number of the multiple fitting grooves 111' and that of the multiple connecting slots 112' defined on the lower fixing element 114' are respectively 8. Specifically, one end of each of 8 first pins 12' fits each fitting groove 111' defined on the upper fixing element 113' respectively, the other end thereof passes through each connecting slot 112' defined on the upper fixing element 113' respectively; one end of each of the other 8 first pins 12' fits each fitting groove 111' defined on the lower fixing element 114' respectively, the other end thereof passes through each connecting slot 112' defined on the lower fixing element 114' respectively.

In some other embodiments, the first pins 12' fixed on the upper fixing element 113' and the first pins 12' fixed on the lower fixing element 114' can be alternately arranged. The number of the multiple first pins 12' can be 10, 12, 18, 24, 36, etc.

Figure 11:
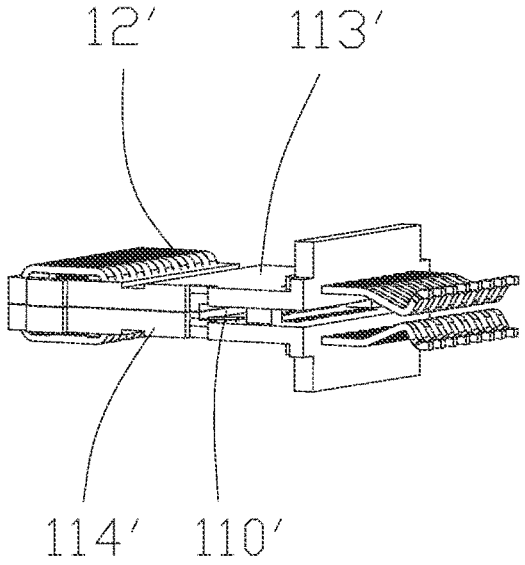
FIG. 11 is a perspective view of first pins and the fixing member according to the second embodiment of the present disclosure.

Referring to FIG. 10 and FIG. 11, the upper fixing element 113' defines an upper notch 1131' between the fitting groove 111' and the connecting slot 112'. The lower fixing element 114' defines a lower notch 1141' between the fitting groove 111' and the connecting slot 112'. When the upper fixing element 113' matches the lower fixing element 114', the upper notch 1131' the lower notch 1141' accordingly cooperate to define an accommodating room 110'. The upper notch 1131' is provided with an upper positioning column 1132' and an upper positioning hole 1133'. The lower notch 1141' is provided with a lower positioning column 1142' and a lower positioning hole 1143'. The upper positioning column 1132' corresponds to the lower positioning hole 1143', and the lower positioning column 1142' corresponds to the upper positioning hole 1133', so as to position the upper fixing element 113' and the lower fixing element 114'. It can be understood that, the upper positioning column 1132' and lower positioning hole 1143' can be disposed on one of the upper fixing element 113' and the lower fixing element 114', the upper positioning hole 1133' and the lower positioning column 1142' are disposed on the other of the upper fixing element 113' and the lower fixing element 114', which can also position the upper fixing element 113' and the lower fixing element 114'.

Referring to FIG. 9 and FIG. 11, the first terminal head 1' further includes a casing 13'. The casing 13' includes an outer housing 131' and a connecting element 132'. The connecting element 132' is disposed on the inner wall of the outer housing 131'. In the specific embodiment, the outer housing 131' is configured as U-shaped, so two ends of the connecting element 132' are respectively connected to two opposite inner walls of the outer housing 131'. The fixing member 11' is disposed inside the outer housing 131', and the connecting element 132' is accommodated in the accommodating room 110' of the fixing member 11'.

It can be understood that, further referring to FIG. 9, the connecting element 132' is configured as II-shaped, therefore, the connecting element 132' defines a first open end 1321' and a second open end 1322'. When the fixing member 11' matches the casing 13', the upper positioning column 1132' fits one of the first open end 1321' and the second open end 1322', and the lower positioning column 1142' fits the other of the second open end 1322' and the first open end 1321'. The first open end 1321' and the second open end 1322' limit the movement of the upper positioning column 1132' and the lower positioning column 1142', which ensures that there is no relative movement between the casing 13' and the fixing member 11', and further stabilizes the matching between the casing 13' and the fixing member 11'.

Referring to FIG. 9 and FIG. 10 again, in the specific embodiment, in order to ensure the connection between the casing 13' and the multiple first pins 12', the upper notch 1131' is provided with an upper ground hole 1134' at an edge thereof, and the lower notch 1141' is provided with a lower ground hole 1144' at an edge thereof away from the upper ground hole 1134'. One of the multiple first pins 12' passes through the upper ground hole 1134'. The part of the one first pin 12', corresponding to the upper ground hole 1134', is exposed by the upper ground hole 1134' of the upper notch 1131' from the upper fixing element 113', and contacted with the connecting element 132'. One of the multiple first pins 12' passes through the lower ground hole 1144', the part of the one first pin 12', corresponding to the lower ground hole 1144' is exposed by the lower ground hole 1144' of the lower notch 1141' from the lower fixing element 114', and contacted with the connecting element 132'.

It can be understood that, the connecting element 132' is made of metal materials. The two first pins 12' contacting with the upper ground hole 1134' and the lower ground hole 1144' are ground electrodes, thereby realizing the grounding of the multiple first pins 12'. The multiple first pins 12' are fixed on the fixing member 11' and are connected to the casing 13'. The upper ground hole 1134' and the lower ground hole 1144' are provided, which realizes an electrical connection between the first pins 12' and the casing 13'. There is no need to set a PCB board and no need to solder the multiple first pins 12', so that the structure of the first terminal head 1' is simpler and easy to assemble, which can reduce the manufacturing difficulty and manufacturing cost of the first terminal head 1'. Further, due to the limited volume of the first terminal head 1', more first pins 12' can be fixed in the first terminal head 1' by a fixing method without soldering.

In some other embodiments, the positions of the upper ground hole 1134' and the lower ground hole 1144' can be adjusted according to actual requirements.

Figure 12:
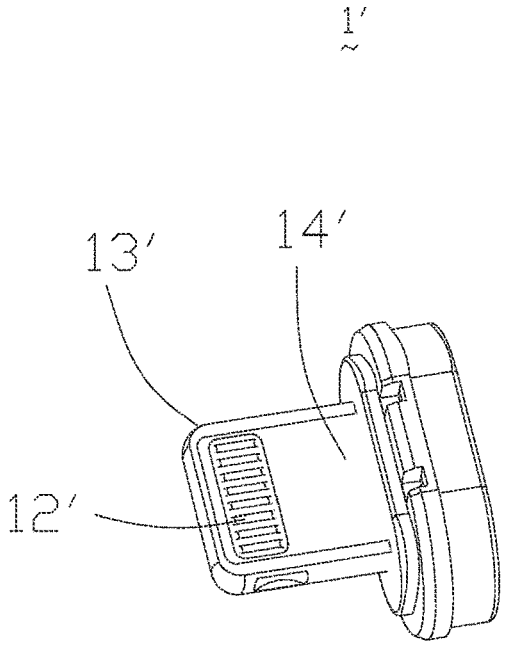
FIG. 12 is a perspective view of the first terminal head according to the second embodiment of the present disclosure.

Referring to FIG. 9, FIG. 10 and FIG. 12, the first terminal head 1' includes an injection mold 14'. The injection mold 14' is disposed in the casing 13'. The outer wall of the injection mold 14' matches the inner wall of the casing 13'. Further, the fixing member 11' is disposed in the injection mold 14'. The part of the multiple first pins 12', which fits the fitting groove 111' and is exposed from the fixing member 11', is also exposed from the injection mold 14'.

It can be understood that, when the fixing member 11', the multiple first pins 12' and the casing 13' are matched, an injection molding is performed inside the casing 13' to form the injection mold 14'. Therefore, the injection mold 14' and the fixing member 11' are disposed inside the casing 13'. The part of the multiple first pins 12', which fits the fitting groove 111' and is exposed from the fixing member 11', is in contact with electronic devices, thus, the injection mold 14' cannot cover the part of the multiple first pins 12' which fits the fitting groove 111' and is exposed from the fixing member 11'. Therefore, this part of the multiple first pins 12' is exposed from the injection mold 14'. The injection mold 14' not only protects the fixing part 11', but also fixes the multiple first pins 12' more stably.

Figure 13:
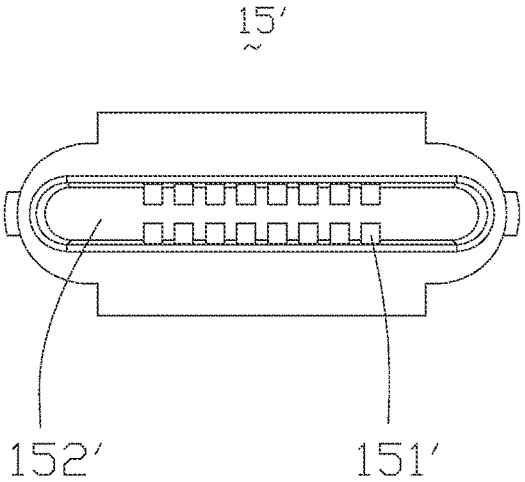
FIG. 13 is a front view of the integration part according to the second embodiment of the present disclosure.

Further, referring to FIG. 9 and FIG. 13, the first terminal head 1' includes a collection part 15'. The casing 13' defines a recess 133' at two ends thereof respectively. One end of the collection part 15' matches the recess 133' at one end of the casing 13', the other end of the collection part 15' matches the recess 133' at the other end of the casing 13', thereby fixing the collection part 15' to the casing 13'. Meanwhile, an end of each first pin 12' passing through each connecting slot 112' is fixed in the collection part 15'.

It can be understood that, the collection part 15' integrates the multiple first pins 12'. The collection part 15' is provided with multiple seating grooves 151', and the multiple first pins 12' are correspondingly disposed in the seating grooves 151' one by one.

The first terminal head 1' includes a first magnetic member 16' and an adapting member 17'. The first magnetic member 16' is sleeved on the collection part 15', and has a certain protective effect on the collection part 15'. The adapting member 17' is sleeved on the first magnetic member 16', serving to fix and protect the first magnetic member 16' and the collection part 15'.

Figure 14:
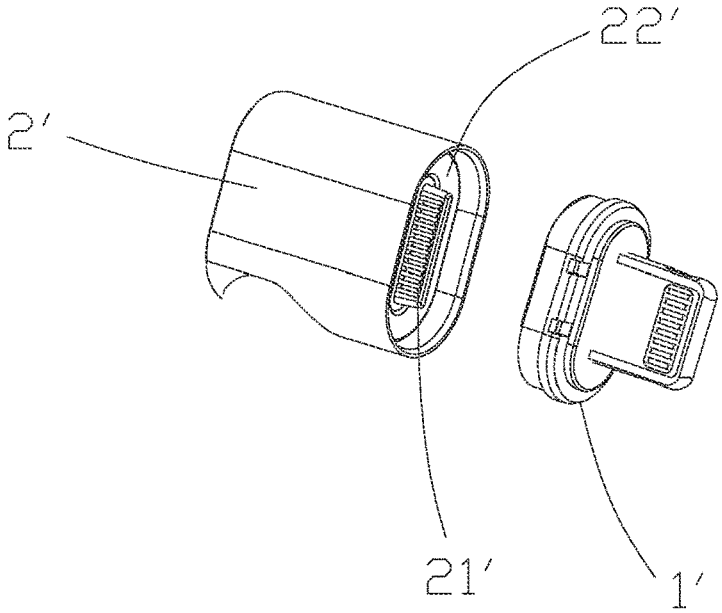
FIG. 14 is another schematic diagram of the first terminal head and the second terminal head of the connector according to the second embodiment of the present disclosure.
Figure 15:
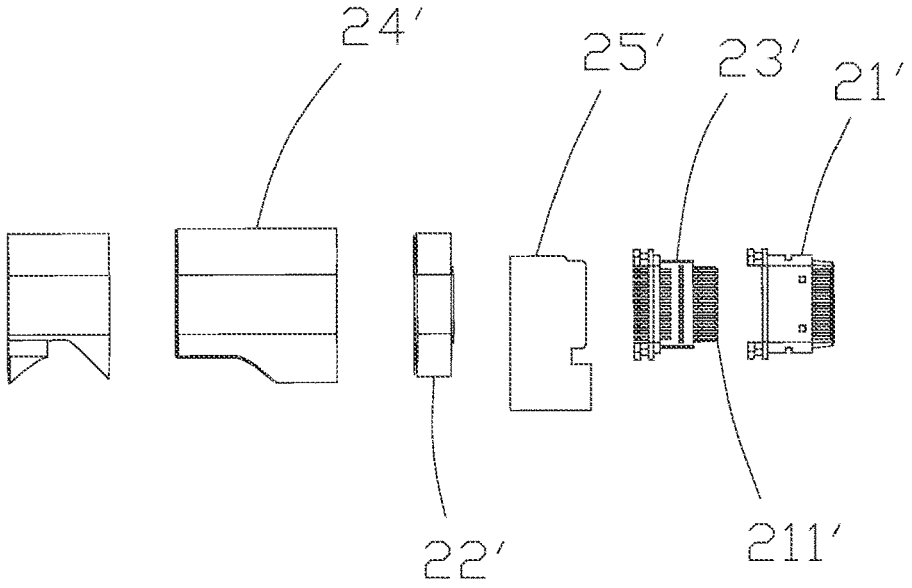
FIG. 15 is an exploded schematic diagram of the second terminal head of the connector according to the second embodiment of the present disclosure.
Figure 16:
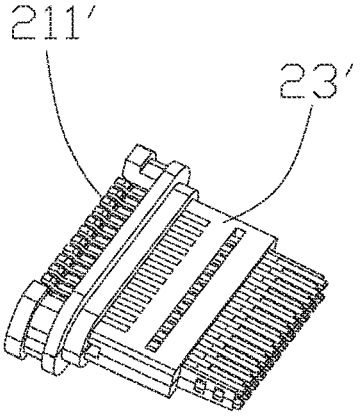
FIG. 16 is a schematic diagram of second pins and a second fixing member of the connector according to the second embodiment of the present disclosure.
Figure 17:
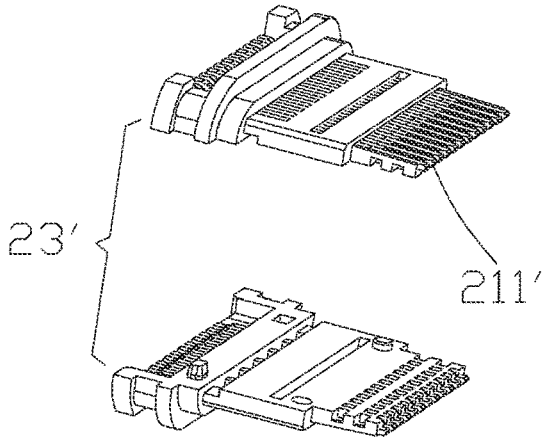
FIG. 17 is another schematic diagram of the second pins and the second fixing member of the connector according to the second embodiment of the present disclosure.

Referring to FIG. 9 and FIG. 14, the internal structure of the first terminal head 1', such as the fixing member 11', the multiple first pins 12' and the injection mold 14', can also be applicable for the second terminal head 2'. In the specific embodiment, 24 pins are provided in the second terminal head 2', so the fixing member 11' for fixing the 16 first pins 12' cannot be used. Therefore, in the specific embodiment of the present disclosure, the internal structure of the second terminal head 2' is different from that of the first terminal head 1'.

Referring to FIGS. 14-17, the second terminal head 2' includes a plugboard 21', a second magnetic member 22', a second fixing member 23', multiple second pins 211', a second protective shell 24' and a PCB board 25'.

Specifically, the second magnetic member 22' is sleeved on the plugboard 21', and the second fixing member 23' is disposed in the plugboard 21'. The multiple second pins 211' are disposed and fixed in the second fixing member 23'. Both ends of the multiple second pins 211' are exposed from the second fixing member 23'. The part of the multiple second pins 211', which is exposed from the second fixing member 23', is also exposed from the plugboard 21' The part of the multiple second pins 211', which is exposed from the second fixing member 23' and the plugboard 21', is connected to the PCB board 25'. Further, the second protective shell 24' is sleeved on the plugboard 21', so as to protect the plugboard 21', the second pins 211', the second magnetic member 22', the second fixing member 23' and the PCB board 25'.

The first magnetic member 16' and the second magnetic member 22' are magnetically attracted, so as to achieve a magnetic connection between the first terminal head 1' and the second terminal head 2'. Further, the collection part 15' includes a port 152' at an end thereof away from the connecting slot 112'. When the first terminal head 1' and the second terminal head 2' are magnetically connected, the plugboard 21' inserts into the port 152', and the first pins 12' passing through the upper fixing element 113' and the corresponding first pins 12' passing through the lower fixing element 114' elastically electrically connect to the multiple second pins 211' At this time, the multiple second pins 211' contact with the multiple first pins 12 in the collection part 15', so as to achieve an electrical connection between the first terminal head 1' and the second terminal head 2'.

It can be understood that, the second terminal head 2' includes 24 second pins 211'; when the first terminal head 1' provided with 16 first pins 12' is connected to the second terminal head 2', only 16 first pins 12' and 16 second pins 211' are electrically connected, to ensure the normal operation between the first terminal head 1' and the second terminal head 2'. Meanwhile, the second terminal head 2' is also applicable for the first terminal head 1' provided with less than or equal to 24 first pins 12'. For example, the second terminal head 2' can be connected to a 24-pin type-c plug, or a 16-pin lightning plug.

Further, in some other embodiments, the internal structure of the first terminal head 1' may be the same as that of the second terminal head 2'. For example, the fixing member 11' can be disposed in the second terminal head 2', the multiple second pins 211' are disposed through the fixing member 11', and the fixing member 11' is disposed in the plugboard 21'. Both ends of the multiple second pin 211' passing through the fixing member 11' are exposed from the plugboard 21', the exposed part of the multiple second pin 211' is used for an electrical connection with cables or the first terminal head 1', and the second protective shell 24' is sleeved on the plugboard 21'.

Figure 18:
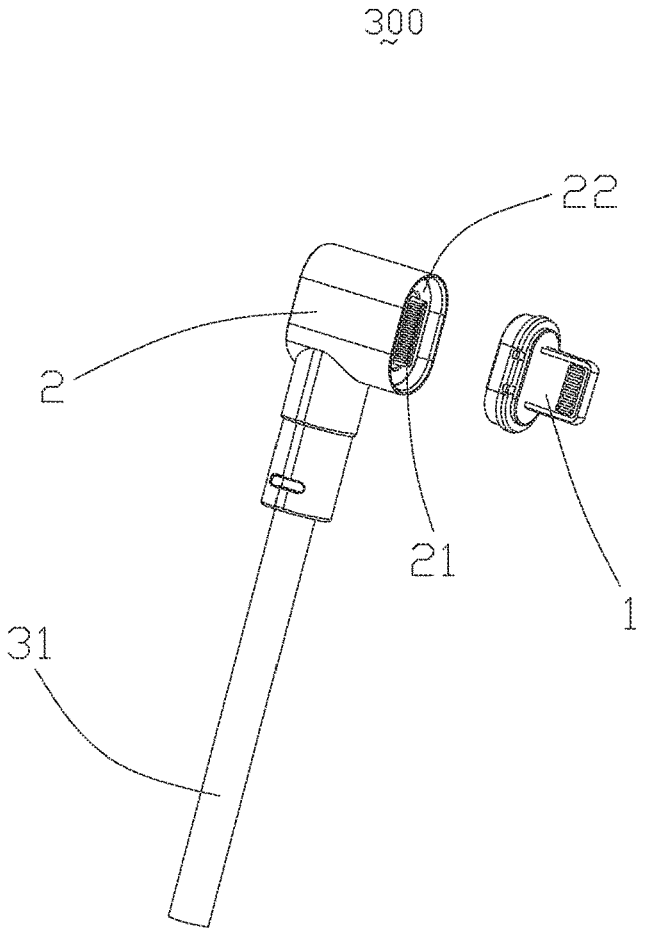
FIG. 18 is a perspective view of a cable with connector according to a third embodiment of the present disclosure.

Referring to FIG. 18, a third embodiment of the present disclosure provides a cable 300 with connector. The cable 300 with connector includes the connector 100 provided in the first embodiment of the present disclosure and/or the connector 200 provided in the second embodiment of the present disclosure. The cable 300 with connector further includes a cable 31 and an interface. One end of the cable 31 is electrically connected to the second terminal head 2, and the other end is connected to the interface. The first terminal head 1 and the second terminal head 2 are magnetically attracted and plug-fitted to form an electrical connection.

It can be understood that, the first terminal head 1 provided by the specific embodiments of the present disclosure takes a lightning plug or a type-c plug as an example, and is magnetically attracted with the second terminal head 2. When it is necessary to use other types of first terminal heads, such as Android plugs, the structure provided by the specific embodiments of the present disclosure can also be applicable and adjusted accordingly. Therefore, different types of first terminal heads can be replaced to charge or transmit data for different electronic devices. Further, the interface can also be adjusted according to actual requirements. For example, the interface can be an USB interface, a type-c interface, an Android interface, a lightning interface, and so on.

The foregoing descriptions of the embodiments according to the present disclosure should not be construed as limiting the scope of the disclosure but as merely providing illustrations of some of the preferred embodiments thereof. Thus the scope of the disclosure should be determined by the appended claims and their legal equivalents. Furthermore, it will be apparent to those skilled in the art that various modifications, equivalents and improvements can be made herein within the scope of the disclosure.

The invention claimed is:

1. A electronic connector, comprising a first terminal head and a second terminal head, the first terminal head and the second terminal head being detachably connected, the first terminal head comprising a plurality of first pins and a fixing member, the fixing member comprising an upper fixing element and a lower fixing element; the plurality of first pins being respectively fixed on the upper fixing element and the lower fixing element, a part of the plurality of first pins passing through the upper fixing element, and the other part of the plurality of first pins passing through the lower fixing element; when the first terminal head and the second terminal head are connected, wherein one end of each first pin is electrically connected to the second terminal head, and the other end thereof is electrically connected to an external device; the first terminal head further comprising a protective shell and an integration part which is connected to an end of the protective shell close to the fixing member; the integration part defining a plurality of seating grooves corresponding to the plurality of first pins, and the plurality of first pins being disposed in the multiple of seating grooves; and being in a position to make electrical and mechanical contact with pins of the second terminal head.

2. The electronic connector according to claim 1, wherein the first pins passing through the upper fixing element correspond to the first pins passing through the lower fixing element one by one.

3. The electronic connector according to claim 2, wherein the first terminal head further comprises a supporting clamp, being partially accommodated in a through slot, which the through slot is defined by the upper fixing element and the lower fixing element.

4. The electronic connector according to claim 3, wherein one of the supporting clamp and the fixing member comprises a positioning column, the other one thereof comprises a positioning hole; which the supporting clamp and the fixing member are matched by the positioning column and the positioning hole.

5. The electronic connector according to claim 3, wherein; the plurality of first pins, the fixing member and the supporting clamp are disposed in the protective shell; and the protective shell defines a dodging slot for dodging the supporting clamp.

6. The electronic connector according to claim 5, wherein one of the protective shell and the fixing member comprises an engagement block, the other one thereof defines an engagement hole; where the protective shell and the fixing member cooperate through the engagement block and the engagement hole.

7. The electronic connector according to claim 1, wherein the fixing member defines a plurality of fitting grooves at one end thereof, and a plurality of connecting slots at the other end; one end of each first pin fits the plurality of fitting grooves and is exposed from the fixing member, the other end thereof passes through the connecting slot.

8. The electronic connector according to claim 7, wherein the second terminal head comprises the plurality of second pins; the number of the plurality of first pins disposed in the first terminal head is 16, and the number of the plurality of second pins disposed in the second terminal head is 24; when the first terminal head and the second terminal head are connected, one of the plurality of first pins is correspondingly contacted with one of the plurality of second pins.

9. The electronic connector according to claim 7, wherein each of the upper fixing member and the lower fixing member are correspondingly provided with the plurality of fitting grooves and the plurality of connecting slots; one end of each first pin fits one fitting groove of the upper fixing member or the lower fixing member, the other end thereof passes through one connecting slot of the upper fixing member or the lower fixing member; the upper fixing member defines an upper notch between the fitting groove and the connecting slot, the lower fixing member defines a lower notch between the fitting groove and the connecting slot; the upper notch and the lower notch cooperate to define an accommodating room.

10. The electronic connector according to claim 9, wherein the second terminal head comprises a second fixing member, a PCB board, the plurality of second pins and a plugboard; the second fixing member is disposed in the plugboard, a part of the plurality of second pins, which fits the fitting groove and is exposed from the second fixing member, is also exposed from the plugboard; an end of the plurality of second pins close to the connecting slot is connected to the PCB board.

11. The electronic connector according to claim 10, wherein the second terminal head further comprises the second magnetic member and a second protective shell; the second magnetic member is sleeved on the plugboard, and the second protective shell is sleeved on the second magnetic member.

12. The electronic connector according to claim 9, wherein the first terminal head further comprises a casing, the casing comprises an outer housing and a connecting element; the connecting element is accommodated in the accommodating room, and two ends of the connecting element extend out the accommodating room to connect to two opposite inner walls of the outer housing.

13. The electronic connector according to claim 12, wherein the upper notch comprises an upper ground hole, and the lower notch comprises a lower ground hole; one of the plurality of first pins corresponds to the upper ground hole, being exposed by the upper ground hole of the upper notch from the upper fixing element and contacted with the connecting element; one of the plurality of first pins passes through the lower ground hole, being exposed by the lower ground hole of the lower notch from the lower fixing element and contacted with the connecting element.

14. The electronic connector according to claim 12, wherein the first terminal head comprises an injection mold, the fixing member is disposed in the injection mold; a part of the plurality of first pins, which fits the fitting groove and is exposed from the fixing member, is also exposed from the injection mold; the injection mold is disposed in the casing, and an outer wall of the injection mold matches to an inner wall of the casing.

15. The electronic, connector according to claim 12, wherein the first terminal head comprises a collection part which matches an end of the casing close to the connecting slot, the other ends of the plurality of first pins passing through the connecting slot are fixed in the collection part.

16. The electronic connector according to claim 15, wherein the first terminal head comprises the first magnetic member and an adapting member, the first terminal head is sleeved on the fixing member, and the adapting member is sleeved on the first magnetic member.

17. The electronic connector according to claim 1, wherein the integration part comprises a port disposed at an end thereof away from the fixing member; the second terminal head comprises a plugboard provided with a plurality of second pins, when the first terminal head and the second terminal head are connected, the plugboard inserts into the port, and the first pins passing through the upper fixing element and the corresponding first pins passing through the lower fixing element elastically electrically connect to the plurality of second pins.

18. The electronic connector according to claim 17, wherein the first terminal head comprises a first magnetic member sleeved on an end of the protective shell close to the integration part; the second terminal head comprises a second magnetic member sleeved on the plugboard; the first magnetic member and the second magnetic member are magnetically connected.

19. A cable with an electronic connector, comprising the electronic connector of claim 1, the cable and an interface; one end of the cable being electrically connected to the second terminal head, and the other end thereof being connected to the interface; the first terminal head and the second terminal head being magnetically attracted and plug-fitted to form an electrical connection, thereby realizing the electrical connection between the first terminal head, the second terminal head and the interface.

* * * * *